United States Patent [19]

Reuss et al.

[11] 4,210,488

[45] Jul. 1, 1980

[54] PROCESS FOR IMPROVING THE DRY STRENGTH OF PAPER AND FOR IMPROVING THE EFFECT OF OPTICAL BRIGHTENERS IN THE PREPARATION OR COATING OF PAPER

[76] Inventors: Peter J. Reuss, Starenkamp 33, D-2080 Pinneberg; Josef Weigl, Bauseweinallee 86, D-8000 Muenchen 60, both of Fed. Rep. of Germany

[21] Appl. No.: 14,543

[22] Filed: Feb. 23, 1979

Related U.S. Application Data

[63] Continuation-in-part of Ser. No. 841,972, Oct. 13, 1977, abandoned.

[51] Int. Cl.[2] ..... D21H 3/80

[52] U.S. Cl. ..... 162/162; 162/168 N; 162/175; 162/177; 162/181 R; 162/181 B; 162/181 C; 162/181 D; 162/181 A; 162/183; 427/158

[58] Field of Search ..... 162/162, 168 N, 168 NA, 162/183, 181 R, 181 A, 181 B, 181 C, 181 D, 175, 177; 427/158; 260/17.4 ST; 536/50; 252/301.33, 301.34, 301.35, 301.23

[56] References Cited

U.S. PATENT DOCUMENTS

| | | | |
|---|---|---|---|
| 3,453,262 | 7/1969 | Roberts | 536/50 |
| 3,639,208 | 2/1972 | Varveri et al. | 162/168 NA |
| 4,066,494 | 1/1978 | Scharf et al. | 162/164 EP |

FOREIGN PATENT DOCUMENTS

| | | | |
|---|---|---|---|
| 548484 | 4/1974 | Switzerland | 162/162 |

*Primary Examiner*—William F. Smith

*Attorney, Agent, or Firm*—Stevens, Davis, Miller & Mosher

[57] ABSTRACT

A process for improving the dry strength of paper and for improving the effect of optical brighteners in the preparation or coating of paper which includes the step of adding fillers and/or pigments and anionic brighteners to the paper making process the improvement comprising adding to paper making pulp a polypiperidine halide absorbed in a dispersed state on a fine-particle organic or inorganic carrier before the anionic brightener is added.

13 Claims, No Drawings

PROCESS FOR IMPROVING THE DRY STRENGTH OF PAPER AND FOR IMPROVING THE EFFECT OF OPTICAL BRIGHTENERS IN THE PREPARATION OR COATING OF PAPER

This application is a continuation-in-part of the inventors' United States Application Ser. No. 841,972, filed Oct. 13, 1977, abandoned.

The invention relates to a process for improving the dry strength of paper and for improving the effect of optical brighteners in the preparation or coating of paper.

For the purpose of achieving a maximum degree of brightness the paper industry has various methods at its disposal, such as selecting very bright paper raw materials, bleaching the raw material, and using fillers or white pigments, tinting dyes and/or optical brighteners.

The high demands for quality that the final product has to meet nowadays particularly in the field of printing paper necessitate increasing quality in the fillers and pigments employed. For limitations on the addition level of fillers and pigments one has the increasing use of two sides of the paper, increasing wire wear, but above all the decrease of the strength properties. The strength properties are impaired by the addition of fillers or pigments inasmuch as the surface bonds of the fibers with each other are disturbed.

When selecting fillers and pigments for addition to the paper finish, particle size and particle shape, hiding power and brightness, low abrasion, uniformity and purity of the material supplied, have to be considered.

For coating pigments the binder requirement, dispersing properties and favorable rheological behaviour are of additional significance.

Considering these limiting factors for the addition level of fillers and pigments, so-called optical brighteners have been increasingly employed in recent years to improve the degree of brightness in paper finish as well as in the steps of coating and coloring.

The optical brighteners do not hide the conventional yellowish shade of the paper by subtraction but substitute for the lack of remission by emitting additional fluorescent light. Optical brighteners shift the shade of the brightened material e.g. from yellow towards blue, and the increase in emission results in an increase in brightness.

The application of optical brighteners with fillers and pigments causes the difficulty that fillers and pigments generally reduce the effect of brighteners in the paper because they absorb light in the UV range or have a yellow shade. In addition, the decrease in effectiveness of fillers or pigments appears to be related to their refractive index and hiding properties.

It is the object of this invention to provide a process for improving the effect of optical brighteners in the paper industry whereby the undesired effect of fillers or pigments on optical brighteners is decreased or essentially eliminated. An increase in brightness simultaneously with improved retention properties of the employed materials and an increase in the strength characteristics of the paper are achieved.

The problem underlying the invention is solved by a process for improving the dry strength of paper and for improving the effect of optical brighteners in the preparation or coating of paper which includes the step of adding fillers and/or pigments and anionic brighteners to the paper making process the improvement comprising adding to the paper making pulp a polypiperidine halide adsorbed in a dispersed state on a fine-particle organic or inorganic carrier before the anionic brightener is added.

According to a special embodiment of the invention the polypiperidine halide used is polypiperidine chloride or polydimethyl diallyl ammonium chloride. The respective bromide may be used as well.

Surprisingly, it was found that the performance of optical brighteners can be considerably increased by including minor quantities of the cationic polymer, polypiperidine chloride, and that when fillers and/or pigments are added to the previous admixture of the cationic polymer the substantive adsorption of the optical brightener is improved or made possible, thus making the brightener highly effective.

The carriers employed for the polypiperidine halide can be either finely divided inorganic materials, e.g. fillers, such as kaolin or talcum, and white pigments, such as calcium carbonate magnesium silicate, aluminum silicate, calcium silicate or silica gel; or organic carriers, such as starch, carboxymethyl cellulose, fine-particle cellulose fiber of various degrees of pulping or fine-particle size mechanical wood pulp.

It has been proven particularly advisable to slurry a filler or a pigment or an organic carrier and a polypiperidine halide in aqueous solution and to add such slurry to the paper pulp e.g. in the finish chest or the beater, or to a coating color for paper, before adding the optical brightener.

The optical brighteners employed in the paper industry are anionic substances. Particularly, derivatives of diamino stilbene disulphonic acid, preferably condensation products containing triazine ring compounds, are used.

Special advantages will result when the polypiperidine halide is employed in the presence of starch, particularly in such quantities that the starch is at least partially modified.

In order to achieve the effect according to the invention, it is sufficient to use minor quantities of polypiperidine halide, particularly of polypiperidine chloride. Quantities of e.g. 0.05 to 1% by weight, particularly 0.1 to 0.3 weight % polypiperidine halide, based on the pigment or filler, have been proven suitable.

In case starch is used, the following quantities can be employed: 0.1 to 1.0 weight %, particularly 0.5 to 1 weight % starch and 0.05 to 1 weight % polypiperidine halide, based on the pigment or filler. The substances are heated in aqueous medium to temperatures of between 40° and 70° C., after cooling the inorganic or organic carrier is added and the anionic optical brightener is brought into contact with the materials thus treated.

The invention will now be explained in more detail by means of Examples. The polypiperidine halide employed in the Examples was polypiperidine chloride or polydimethyl diallyl ammonium chloride commercially available as Polymer 261 as 40% aqueous solution (cf. M. Fred Hoover and Hugh E. Carr "Performance-Structure Relationships of Electro-conductive Polymers", Tappi, The Journal of the Technical Association of the Pulp and Paper Industry, Vol. 51, No. 12, December 1968, pages 552 to 559; and U.S. Pat. No. 3,288,770), hereinafter called "cationic polymer".

In the Examples all quantities and percentages are by weight, unless otherwise designated.

EXAMPLE 1

The cationic polymer was adsorbed on pigment surfaces by dispersing various pigments, which were slurried in water of room temperature (solids content 20 to 55 weight %) and which are listed in Table I below, in an aqueous solution of 1 to 10 weight % of the cationic polymer. After the cationic polymer was adsorbed on the pigment surface, the optical brightener, a commercial brightener (derivative of the diamino stilbene disulphonic acid, BLANKOPHOR of Bayer A.G.) was added. In addition, where required, the starch quantities listed in Table I were added after previous treatment with the cationic polymer.

The practical performance of the procedure was as follows:

The pigments were dispersed in water in a beaker with stirring. The solids content was adjusted to between 20 and 60 weight % solids depending on the kind of pigment and the viscosity resulting therefore. Under constant stirring an aqueous solution of the cationic polymer or a mixture of an aqueous solution of the cationic polymer with a starch addition was then slowly and dropwise—with interruptions—added to the pigment suspension. In order to ensure even adsorption, the mixture was stirred for about 10 minutes. Then the previously dissolved anionic optical brightener also was slowly added under constant stirring.

After further stirring for 10 minutes the brightening effect is clearly recognizable under UV light. The product thus prepared can be employed directly as a slurry in the paper factory, e.g. in the chest or the beater, or can first be dried and then ground and employed in the production or upgrading of paper.

The following results were obtained:

TABLE I

| Pigment (carrier) | % cationic polymer and starch based on pigment | % optical brightener based on pigment | WG(+) |
|---|---|---|---|
| Filler clay | — | 0.15 | 84.2 |
| Filler clay | 0.5% starch<br>0.3% cat.polymer | 0.15 | 88.3 |
| Coating clay | — | 0.15 | 87.6 |
| Coating clay | 0.2% starch<br>0.2% cat.polymer | 0.15 | 88.5 |
| Al-silicate | — | 0.15 | 77.5 |
| Al-silicate | 0.5% cat.polymer | 0.15 | 79.3 |
| Al-silicate | 0.7% starch<br>0.5% cat.polymer | 0.15 | 80.9 |
| $CaCO_3$ | — | 0.15 | 92.8 |
| $CaCO_3$ | 0.2% cat.polymer | 0.15 | 97.8 |
| $CaCO_3$ | 0.1% starch<br>0.1% cat.polymer | 0.15 | 97.6 |
| $CaCO_3$ | 0.5% starch<br>0.2% cat.polymer | 0.15 | 98.4 |

(+)WG = degree of whiteness measured with the "Elrepho" apparatus with xenon lamp, filter R 457

From Table I can be seen that by employing the cationic polymer both with and without the use of starch an increase in brightness of from 3 to 5 points can be achieved.

From the following Table II the characteristics of the pigments and fillers employed can be seen.

TABLE IA

| Pigment | chem. composition | degree of brightness | particle size (μm) | spec. gravity g/cm³ | refractive index (n) | spec. surface m²/g |
|---|---|---|---|---|---|---|
| Pulp-kaolin | $AL_2O_3 . SiO_2 . H_2O$ | 84.2 | 1–5 | 2.6 | 1.56 | 6.8 |
| Brush clay | " | 87.6 | 0.5–2 | 2.6 | 1.56 | 11.5 |
| Al-silicate | — | 77.5 | 1–2 | 2.1 | 1.48 | 140.0 |
| Chalk | $CaCO_3$ | 92.8 | 0.5–2 | 2.7 | 1.56 | 8.0 |

EXAMPLE 2

In order to carry out sheet formation tests on the RK (Rapid-Koethen) sheet former the following pulp composition was prepared:

30 weight % sulphate cellulose, bleached 70 weight % wood pulp, bleached SR degree+): about 65° SR Pigment (carrier): kaolin pH value: 5,5 (adjusted with alum) 0,1% retention aid +) SR degree=Schopper-Riegler degree of beating (freeness).

Run 1: Fiber material+pigment not being pretreated with cationic polymer

Run 2: Fiber material+0,2 weight % cationic polymer +pigment pretreated with cationic polymer +0,2 weight % optical brightener (Cationic polymer and optical brightener in weight %, based in pigment (kaolin), cationic polymer=commercially available 40 percent aqueous dispersion)

Paper Test

The papers were subjected to conditioning in a standard climate at 20 degrees centigrade and 65 percent relative humidity and tested.

Ash

Degree of brightness, measured with the Elrepho-apparatus with filter R 457 (with $R_{457}$ xenon and $R_{457}$ barrier filter) Basis weight: DIN 53 104 Bursting pressure—Schopper: DIN 53 113 Load at rupture, elongation: DIN 53 112

The result are indicated in Table II.

TABLE II

| The following results were obtained: Run | 1 | 2 |
|---|---|---|
| Basis weight g/m² | 94,6 | 94,3 |
| Ash % | 14,7 | 16,4 |
| Load at rupture (N) | 19 | 20 |
| elongation % | 1,2 | 1,3 |
| Bursting pressure (kg/cm²) | 0,45 | 0,48 |
| Degree of brightness, measured with the Elrepho-apparatus with xenon lamp | 58,7 | 61,7 |

From Table II it can be seen that in test run 2 practically there did not occur any decrease in strength inspite of increased pigment or filler contents.

EXAMPLE 3

According to the method described in Example 1 calcium carbonate treated with the cationic polymer was brought into contact with various optical brightener types and concentrations.

TABLE III

| Pigment (carrier) | % cation.polymer based on pigment | % opt.brightener based on pigment | degree of brightness |
|---|---|---|---|
| $CaCO_3$ | 0.2 | 0.05 opt.brightener I(1) | 94.8 |
| $CaCO_3$ | 0.2 | 0.1 dto. | 96.5 |
| $CaCO_3$ | 0.2 | 0.15 dto. | 97.8 |
| $CaCO_3$ | 0.2 | 0.1 opt.brightener II(2) | 96.3 |
| $CaCO_3$ | 0.2 | 0.15 dto. | 97.4 |
| $CaCO_3$ | — | 0.15 dto. | 93.3 |

(1)"Tinopal" of Ciba-Geigy A.G. derivative of an amino stilbene sulphonic acid
(2)"Blankophor P" of Bayer A.G. (derivative of a stilbene disulphonic acid)

EXAMPLE 4

By means of a high speed agitator 1540 g American kaolin were dispersed with 1.5 g polyphosphate (Calgon PTH) as a 70% slurry. Likewise with the help of a high speed agitator 660 g superfinely ground natural calcium carbonate were dispersed as a 70% slurry, using 4.0 g polyacrylate disperser (Polysal CA of BASF).

The calcium carbonate slurry was stirred into the kaolin slurry, so that a 70/30 mixture of kaolin with calcium carbonate in liquid form was obtained. In order to adjust to a strongly alkaline pH value about 9–10 ml of 10% caustic soda solution were added to the pigment mixture. Then, always under intensive stirring, 101 g of 10% ammonium stearate dispersion, 514 g of a 30% boiled potato starch solution viscosity modified with amylase, 137 g of a 46% styrene butadiene latex (XD 8417 of Dow Chemical), 8 g of a stilbene disulphonic acid derivative (Blankophor P of Bayer A.G.) as an optical brightener, and 18 g of an 80% melamine formaldehyde resin (Protex) as a hardener were added. This batch was prepared twice. As a last component 5.5 g of polydiallyl dimethyl ammonium chloride as a 40% aqueous solution was added under intensive stirring to one of the batches.

Both coating colors were applied to a sized base paper containing mechanical wood pulp at a speed of 500 m/min and with a weight of about 10 g/m$^2$ by means of a laboratory applicator (lab heliocoater). The weight of the base paper was about 70 g/m$^2$. The coated paper was calendered after coating by means of a laboratory calender (Kleinwefers) at a temperature of 60° C. and a linear roll pressure of 210 kg/cm. Smoothness of the coated paper was determined with a Bekk tester, gloss at 45° with a Zeiss goniophotometer, brightness and opacity with a Zeiss Elrepho apparatus with xenon lamp.

The results obtained are to be seen from the following Table IV.

TABLE IV

| | invention | comparison |
|---|---|---|
| % cat.polymer based on pigment | 0.2 | — |
| solids content % | 58.2 | 59.2 |
| viscosity$\eta$ 100 cps | 4200 | 1480 |
| 50 cps | 7420 | 2400 |
| pH | 8.7 | 8.9 |
| WRV(1) (sec) | 1'34" | 1'52" |
| smoothness (sec) | 1610 | 1660 |
| gloss 45° | 7.0 | 6.1 |
| WG(2) (filament lamp) | 75.4 | 73.6 |
| WG(2) (xenon lamp) | 76.6 | 75.9 |
| brightness(3) | 82.0 | 80.4 |
| coat weight(g/m$^2$) | 10 | 10 |

TABLE IV-continued

| | invention | comparison |
|---|---|---|
| micro contour test(4) | very good | good |

(1)water retention
(2)degree of brightness
(3)brightness measured with the Zeiss "Elrepho" apparatus
(4)for evaluating wetting with printer's ink Surprisingly it was found that by the use of minor quantities of the cationic polymer (polypiperidine halide, particularly polypiperidine chloride) additionally the dry strength characteristics of the paper were substantially improved.

The advantages achieved by the use of the cationic polymer are apparent from the following Examples.

EXAMPLE 5

In order to carry out sheet formation tests on the RK (Rapid-Koethen) sheet former the following pulp composition was prepared:

50 weight % sulphate cellulose, bleached 30 weight % sulphite cellulose, bleached 20 weight % beech cellulose, bleached SR degree+): about 35° SR pigment (carrier): kaolin, calcium carbonate, untreated in either case and pretreated with cationic polymers pH value: 5.5 in the tests with kaolin pH value: 7.8 in the tests with $CaCO_3$ +) SR degree=Schopper-Riegler degree of beating (freeness).

In each case identical starting quantities of filler were added (about 30 weight % based on the dry fiber weight).

The results obtained in the sheet formation tests are presented in Table V.

TABLE V

| | ash (%) | breaking length (m) longitud. | breaking length (m) transverse |
|---|---|---|---|
| kaolin untreated | 14.4 | 2450 | 2100 |
| kaolin with 0.2% cat. polymers | 16.1 | 2590 | 2250 |
| kaolin with 0.5% cat. polymers | 17.5 | 2350 | 2080 |
| kaolin with 0.5% cat. polymer + 0.1% optical brightener | 17.8 | 2410 | 2095 |
| $CaCO_3$ untreated | 11.0 | 2620 | 2190 |
| $CaCO_3$ with 0.2% cat. polymers | 13.1 | 2710 | 2250 |

Table V shows that because of the positive charge of the filler—caused by the cationic polymer—better adsorption at the negative fiber will occur. In mixtures of untreated filler and treated filler, the untreated kaolin is likewise better retained because of charge neutralization properties which results also in longer wire life.

Treatment of the filler or pigment respectively with the cationic polymer was carried out in accordance with the method described in Example 1 for the practical performance.

The strength characteristics are normally adversely affected by the addition of fillers because the surface bonds—bridging hydrogen bonds—among the cellulose fibers will be disturbed, that is to say the strength decreases considerably with increasing filler content. But surprisingly, by pretreating the fillers with the cationic polymer a certain increase in strength will occur in spite of an increase in filler content. This can possibly be caused by an interaction between the fibers and the polymer at the surface of the filler, contrary to the untreated filler. Since especially with the light weight papers great difficulties arise during converting and processing with regard to strength properties, this result is of special significance.

The improvements obtained by the use of the cationic polymer through modification of native starch are shown in the following Example 6.

EXAMPLE 6

(a) Sheet formation experiments on the RK sheet former Pulp composition:

70 weight % mechanical wood pulp, bleached 30 weight % sulphate cellulose, bleached pH value: 7.0 SR degree: about 40° SR The following materials were added to the paper finish:

| | | |
|---|---|---|
| A | 5 ml | 10% by weight of native potato starch |
| B | 5 ml | 10% by weight of native potato starch mixed with 1% of the cationic polymer and heated to agglutinate |
| C | 5 ml | 10% by weight of native potato starch mixed with 3% of the cationic polymer and heated to agglutinate |
| D | 5 ml | 10% by weight of native potato starch mixed with 5% of the cationic polymer and heated to agglutinate |

The weight of the sheets formed was 2.4 g in each case.

Strength test: Load at rupture according to DIN 53112

| | |
|---|---|
| paper sample A | 2.8 kp |
| paper sample B | 3.2 kp |
| paper sample C | 3.5 kp |
| paper sample D | 3.5 kp |

From the test results a marked strength increase with the modified starches as compared with the native starch is apparent.

(b) Sheet formation experiments on the RK sheet former

Pulp composition: 50 weight % mechanical wood pulp, bleached 50 weight % sulphate pulp, bleached pH value: 7.0 SR degree: about 40° SR The following materials were added to the pulp mixture:

| | | |
|---|---|---|
| A | 1 ml | 10% by weight of native potato starch |
| B | 0.5 ml | 10% by weight of native potato starch mixed with 5% of the cationic polymer and boiled for a short time to agglutinate |
| C | 1 ml | 10% by weight of native potato starch mixed with 5% of the cationic polymer and boiled for a short time to agglutinate |

1% by weight of optical brightener (based on the 2.4 g sheet weight) was added to each of the three different compositions.

Degree of brightness: measured with the "Elrepho" apparatus with xenon lamp.

| Paper sample | degree of brightness |
|---|---|
| A | 79.2 |
| B | 80.5 |
| C | 82.5 |

By the modification of the starch the degree of brightness is improved as the case of fillers and coating pigments.

If modified starch and optical brighteners are mixed beforehand, a major reduction of the brightening effect occurs. The same effect was noted with the paper strengths.

The application of adhesive layers on papers which are dried and can be made to adhere by moistening and contacting with another material such as e.g. also paper, is called "gumming".

The improvement of the adhesive properties by employing minor quantities of the cationic polymer is apparent from the following Example 7.

EXAMPLE 7

A 15% by weight cold soluble starch "solution" in water and a 15% by weight "solution" in water of a cold soluble starch pretreated with 5% by weight of the cationic polymer were applied to a paper base and dried. The adhesive strength was tested after moistening on the "Fipago" adhesive strength testing device (PKL).

| | |
|---|---|
| Sample with normal cold soluble starch (potato starch) | 2.9 mmkp |
| Samle with cold soluble starch (potato starch) pretreated with 5% by weight cat. polymer | 8.4 mmkp |

The pretreated sample showed excellent film forming properties.

A good adhesive bond is generally expected to have a strength above that of the materials bonded together. This demand was fulfilled when the pretreated starch was employed but not with normal starch.

It has generally proved advisable in the modifying of starch to use 0.5 to 6% by weight, particularly 1 to 5% by weight of the polymer based on the weight of the paper fibers.

It is generally advisable for the above described applications of the cationic polymer (polypiperidine halide, particularly polypiperidine chloride) to be made from aqueous solutions containing about 1 to 10 weight % of the cationic polymer.

What is claimed is:

1. In a process for improving the dry strength of paper and for improving the effect of optical brighteners in the preparation of paper which includes the step of adding fillers and/or pigments and anionic brighteners to the paper making process the improvement comprising adding to paper making pulp a polypiperidine halide adsorbed in a dispersed state on a fine-particle organic or inorganic carrier and thereafter adding the anionic brightener to said paper making pulp.

2. The process according to claim 1, wherein the polypiperidine halide is polypiperidine chloride.

3. The process according to claim 1, wherein the polypiperidine halide is polydimethyl diallyl ammonium chloride.

4. The process according to claim 1, wherein said carrier consists of fine-particle inorganic substances selected from the group consisting of kaolin, talcum, calcium carbonate, magnesium silicate, aluminum silicate, calcium silicate and silica gel.

5. The process according to claim 4, wherein from 0.05 to 1% by weight of polypiperidine halide based on the inorganic substance is employed.

6. The process according to claim 4, wherein from 0.1 to 0.4% by weight of polypiperidine halide based on the inorganic substance is employed.

7. The process according to claim 4, wherein from 0.1 to 1.5% by weight of starch and from 0.05 to 1% by weight of polypiperidine halide based on the inorganic substance are employed.

8. The process according to claim 4, wherein from 0.5 to 1% by weight of starch and from 0.05 to 1% by weight of polypiperidine halide based on the inorganic substance are employed.

9. The process according to claim 1, wherein said carrier consists of fine-particle organic substances selected from the group consisting of starch, carboxy methyl cellulose, fine-particle cellulose fiber of various degrees of pulping and fine-particle mechanical wood pulp.

10. The process according to claim 1, wherein said carrier is organic and including slurrying said organic carrier and the polypiperidine halide in aqueous solution.

11. The process according to claim 1, wherein said anionic brighteners are derivatives of diamino stilbene disulphonic acid.

12. The process according to claim 1, including heating said polypiperidine halide with starch prior to contact with said inorganic carrier.

13. The process according to claim 12, including heating the starch and the polypiperidine halide in aqueous medium to temperatures of between 40° and 70° C., cooling said starch and halide containing medium, adding said carrier to said medium.

* * * * *